US008732871B2

(12) United States Patent
Neidich et al.

(10) Patent No.: US 8,732,871 B2
(45) Date of Patent: May 27, 2014

(54) DOOR ASSEMBLY FOR WALK-IN BATHTUB

(75) Inventors: Andre J. Neidich, Boca Raton, FL (US); Robert Buete, Waxhaw, NC (US)

(73) Assignee: Safety Tubs Company, LLC, Piscataway, NJ (US)

( * ) Notice: Subject to any disclaimer, the term of this patent is extended or adjusted under 35 U.S.C. 154(b) by 983 days.

(21) Appl. No.: 12/761,257

(22) Filed: Apr. 15, 2010

(65) Prior Publication Data

US 2010/0263119 A1 Oct. 21, 2010

Related U.S. Application Data

(60) Provisional application No. 61/169,621, filed on Apr. 15, 2009.

(51) Int. Cl.
*A47K 3/02* (2006.01)

(52) U.S. Cl.
USPC ..... 4/556

(58) Field of Classification Search
USPC ..... 4/538–595
See application file for complete search history.

(56) References Cited

U.S. PATENT DOCUMENTS

| | | | | | |
|---|---|---|---|---|---|
| 2,010,045 | A * | 8/1935 | Wells | 211/85.26 |
| 2,456,275 | A * | 12/1948 | Harris | 4/556 |
| 2,991,482 | A * | 7/1961 | Brass | 4/556 |
| 3,663,971 | A * | 5/1972 | Bonhote | 4/556 |
| 3,863,275 | A * | 2/1975 | Brendgord et al. | 4/556 |
| 4,680,817 | A * | 7/1987 | Sloan et al. | 4/663 |
| 4,802,247 | A * | 2/1989 | Leichle et al. | 4/556 |
| 4,890,341 | A * | 1/1990 | Forbes | 4/555 |
| 4,953,241 | A * | 9/1990 | Williams | 4/556 |
| 5,163,187 | A * | 11/1992 | Dannenberg et al. | 4/556 |
| 5,220,696 | A * | 6/1993 | Dannenberg et al. | 4/556 |
| 5,255,400 | A * | 10/1993 | Sween | 4/556 |
| 5,813,062 | A * | 9/1998 | Vago et al. | 4/556 |
| 6,151,727 | A | 11/2000 | Lofquist, Jr. | |
| 6,381,769 | B1 | 5/2002 | Lofquist, Jr. | |
| 6,766,543 | B1 * | 7/2004 | Hollis et al. | 4/555 |
| 7,237,276 | B2 | 7/2007 | Longman | |
| 7,299,509 | B1 * | 11/2007 | Neidich et al. | 4/556 |
| 8,082,609 | B2 * | 12/2011 | Rydalch | 4/590 |
| 8,375,478 | B2 * | 2/2013 | Luo | 4/556 |
| 2005/0044620 | A1 * | 3/2005 | Metcalf | 4/556 |
| 2008/0109954 | A1 * | 5/2008 | Neidich | 4/556 |
| 2010/0263119 | A1 * | 10/2010 | Neidich et al. | 4/556 |

* cited by examiner

*Primary Examiner* — Lori Baker
(74) *Attorney, Agent, or Firm* — Flaster/Greenberg P.C.

(57) ABSTRACT

The disclosure concerns a door assembly for a walk-in bathtub that includes a door that fits within a door threshold in the wall of the walk-in tub. The door assembly further comprises a hinge assembly that includes a first axis mount coupled to the door threshold and a second axis mount coupled to the outer side of the door. A double axis hinge is coupled to both axis mounts, to thereby connect the door to the bathtub. The double axis hinge is able to open the door towards the inside of the tub by pivoting about the first axis toward the inside of the bathtub as the door in turn counter rotates about the second axis at the distal end of the hinge, in the direction opposite to that of the hinge.

20 Claims, 18 Drawing Sheets

DOOR ASSEMBLY FOR WALK-IN BATHTUB

CROSS-REFERENCE TO RELATED APPLICATIONS

This application claims the benefit of and priority to U.S. Provisional Patent Application No. 61/169,621 filed Apr. 15, 2009, the technical disclosures of which are hereby incorporated herein by reference.

TECHNICAL FIELD

The present invention relates generally to walk-in bathtubs and more specifically to an improved door and hinge system for the side of the tub to allow easier access.

BACKGROUND OF THE INVENTION

Walk-in bathtubs comprise high tub walls with a high built in seat and a side door, allowing the user to walk into the tub from the side and sit down without having to climb down into a low bath tub. FIG. 1 shows a typical example of a walk-in bathtub in accordance with the prior art. Walk-in tubs are particularly suited for individuals who have physical limitations that make it difficult or dangerous to climb into and out of a regular, low bathtub or to stand up in a shower for extended periods of time. Such limitations might include physical disabilities or simply the reduced strength, balance and range of motion that typically occur with advancing age. Walk-in tubs are not only easier to enter and exit than conventional bathtubs they also reduce the chances of slips and falls compared to conventional tubs and showers.

In addition to safety, the ease of entering the tub via the side walk-in door also provides users with independence, allowing them to bathe without the assistance of another person when getting into and out of the tub.

Of central importance for walk-in tubs is the design of side door itself. Specifically, the position and swing path of the door affects the operation of the tub and its ease of use. Prior art designs like the one shown in FIG. 1, in which the side door opens to the outside of the tub, have to maintain a proper seal against the outward pressure of the water when the tub is filled. By and large, this task is left up to the locking handle used to close and secure the door. Adding to the difficulty in maintaining a proper seal is the fact that most walk-in tubs do not have a door frame. Instead, the door is merely bolted directly onto the wall of the tub. Depending on the depth of the tub and the materials used in it construction, the perimeter of the door threshold (in the absence of a frame) can buckle and distort under the pressure of the water, leading to potential leaks.

FIG. 2 shows an improved prior art design that overcomes many of the problems noted above. In this design, the side door 201 opens to the inside of the tub. Therefore when the door is closed and the bath is filled, the water pushes against the door in the direction of the closed position, thereby enhancing the strength of the water seal instead of working against it. Also present in this design is a door frame 202 onto which the door 201 is mounted. The frame prevents buckling and warping around the perimeter of the door threshold, thereby preventing leaks in the water seal due to buckling from water pressure against the walls of the tub.

However, despite the advantages of the improved door design shown in FIG. 2, it creates a new problem of its own. As can be seen in the figure, because the door 201 opens inward, it has to swing across the foot well of the tub. If a person is standing or sitting in the tub, the legs have to be moved out of the door's path during opening and closing.

While this may seem like a trivial inconvenience, one must keep in mind that most users of walk-in tubs have some degree of movement impairment. Depending on the size of the foot well of the tub, the size and length of the user's legs and the degree of impairment, the user may have a great deal of difficulty opening and closing the door while inside the tub.

Therefore it would be desirable to have a door design that that opens to the inside of the walk-in tub but does not swing through the foot well of the tub, thereby avoiding interference with the user's legs.

SUMMARY OF THE INVENTION

The present invention provides a door assembly for a walk-in bathtub. The invention includes a door that is shaped to fit a door threshold in the side or end of the walk-in tub. The door has a threshold piece that fits within the door threshold and an internal flat panel that faces the interior of the bathtub when the door is closed. The door assembly further comprises at least one hinge assembly that includes a first axis mount coupled to the door threshold and a second axis mount that is coupled to the outer side of the door. A double axis hinge is coupled to both axis mounts, thereby connecting the door to the bathtub. In an alternate embodiment, the door assembly may include multiple hinge assemblies.

The double axis hinge opens the door to the inside of the tub by pivoting about the first axis toward the interior of the bathtub as the door in turn counter rotates about the second axis at the distal end of the hinge, in the direction opposite to that of the hinge. As a result of this counter rotation of the door the interior panel of the door faces the interior of the bathtub in both the opened and closed positions.

The outer side of the door has a channel that extends across the width of the door and accommodates the second axis mount and allows the hinge to recess into the channel when the door is in the opened and closed positions.

BRIEF DESCRIPTION OF THE DRAWINGS

The novel features believed characteristic of the invention are set forth in the appended claims. The invention itself, however, as well as a preferred mode of use, further objects and advantages thereof, will best be understood by reference to the following detailed description of an illustrative embodiment when read in conjunction with the accompanying drawings, wherein:

DETAILED DESCRIPTION

Figure 3A:
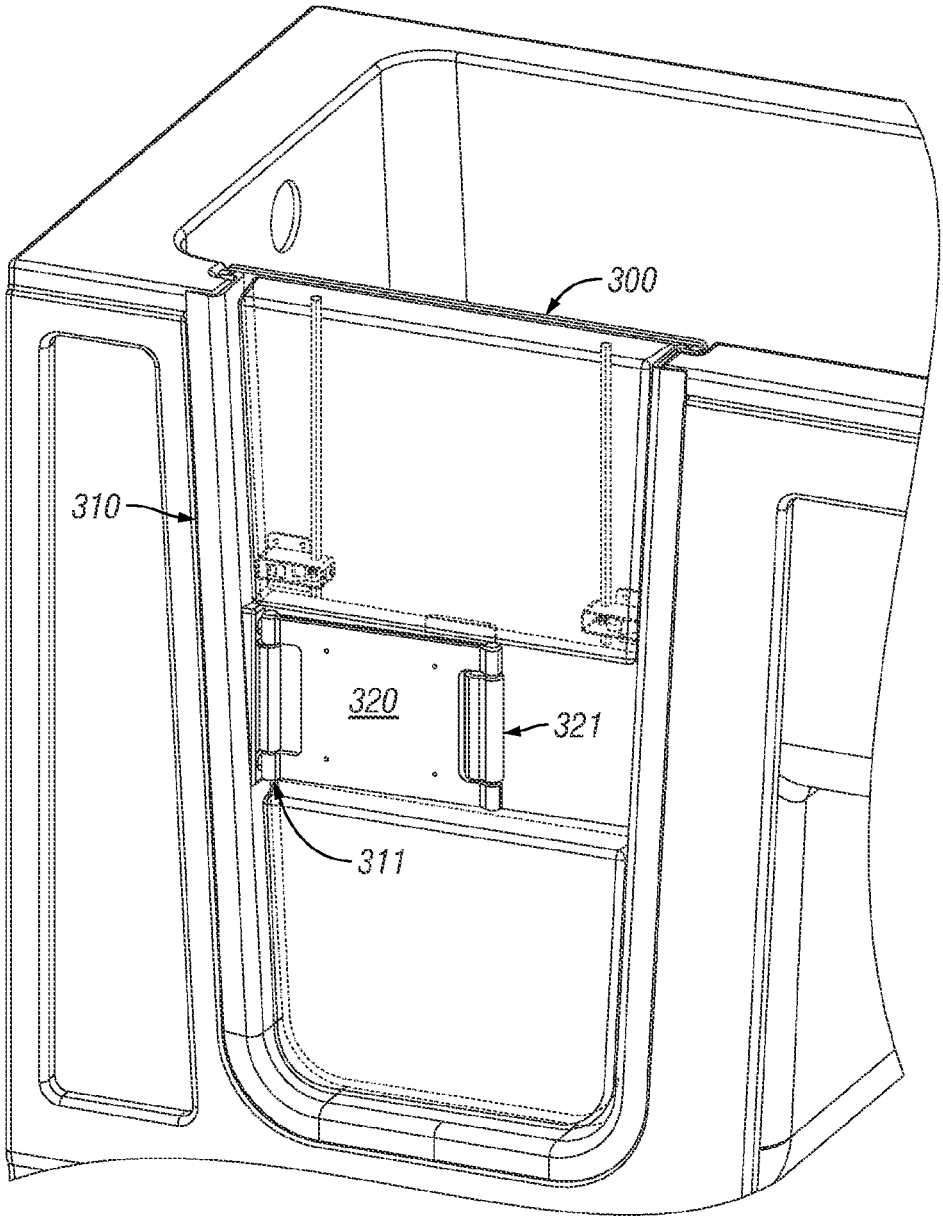
FIGS. 3A-3C show a perspective view of a lever hinged side door for a walk-in bath tub in accordance with a preferred embodiment of the present invention.
Figure 3B:
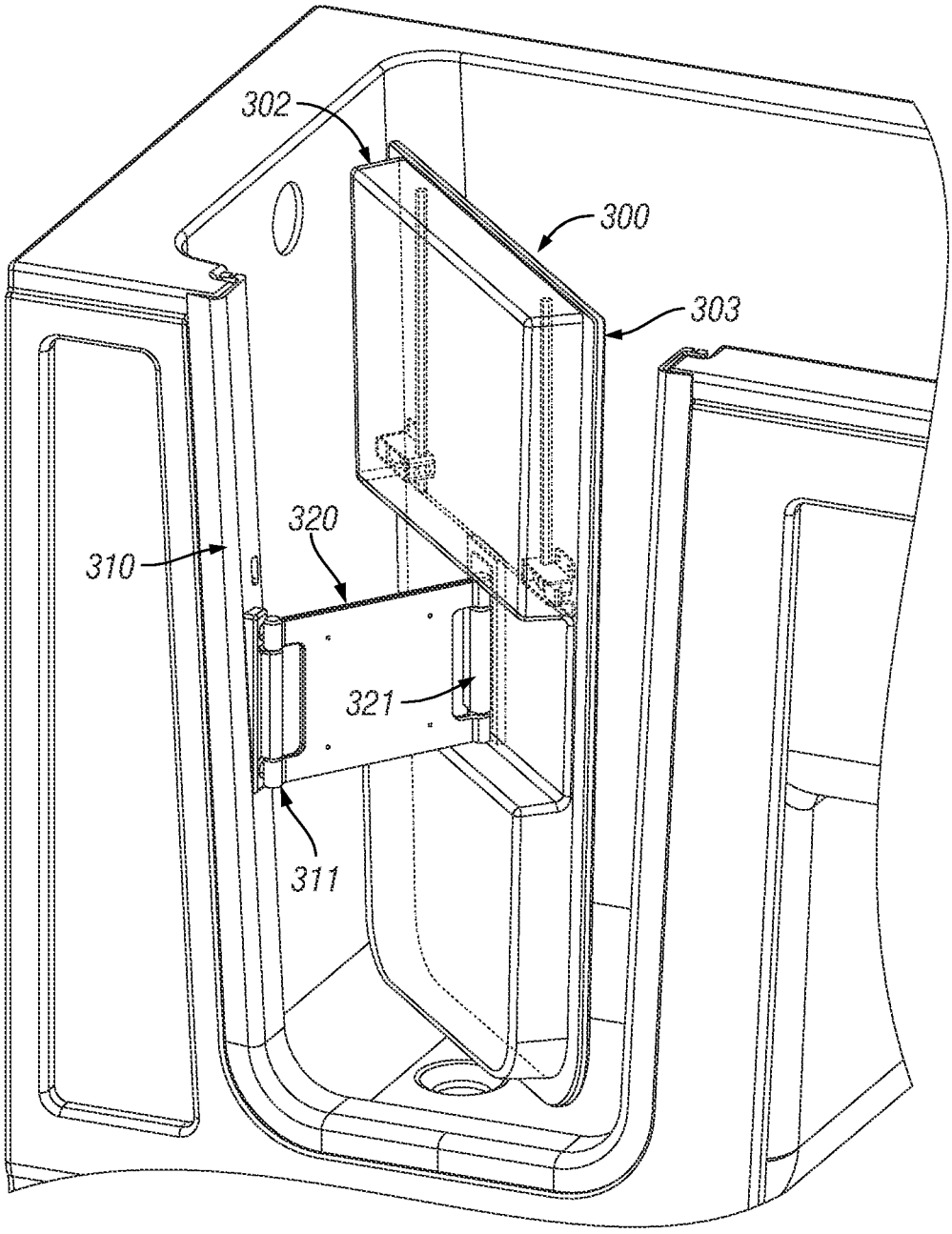
Figure 3C:
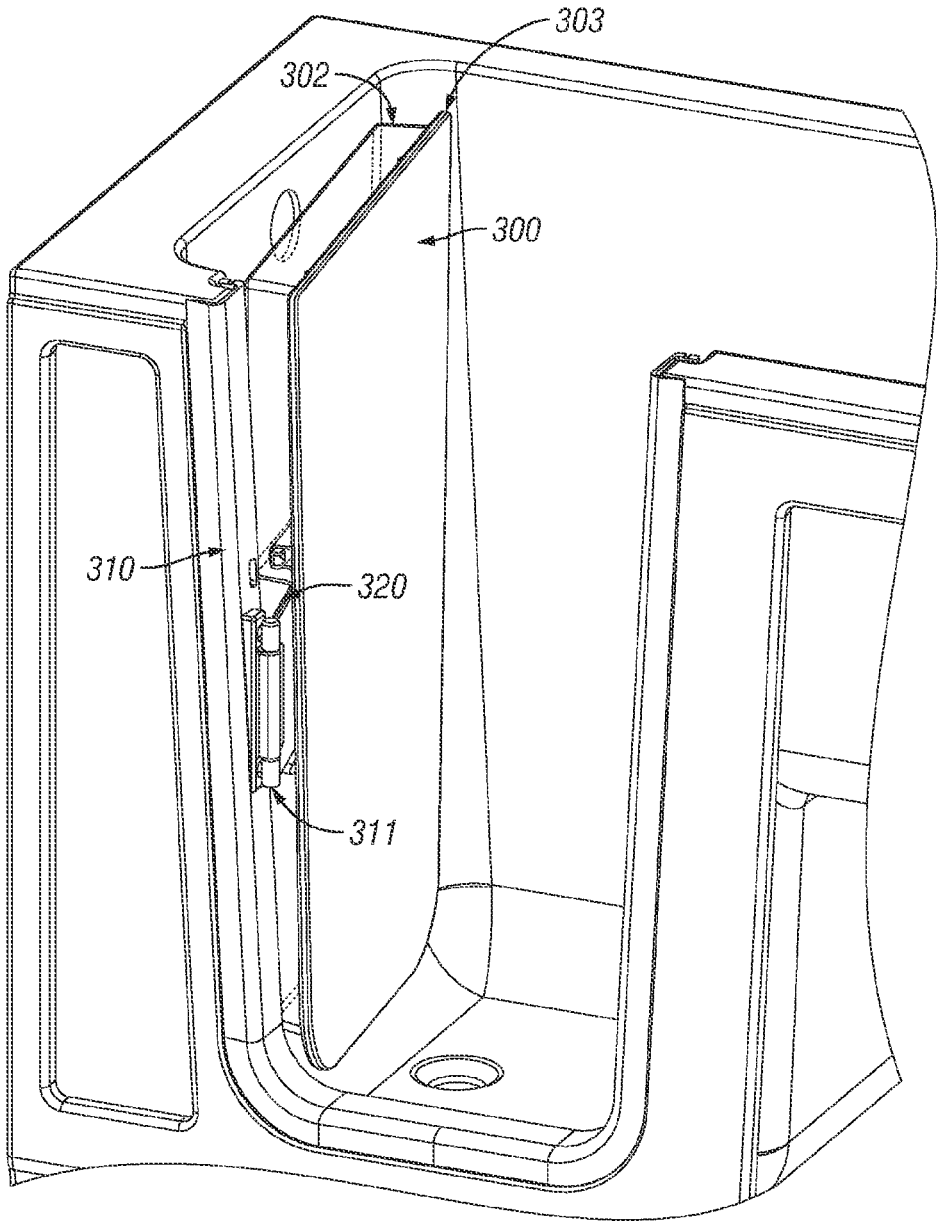
Figure 4A:
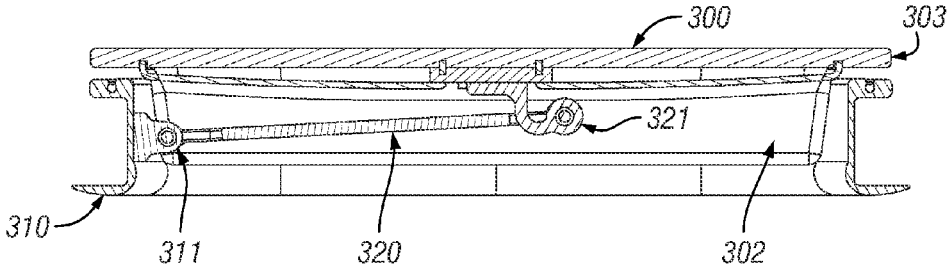
FIGS. 4A-4C show a top plan view of a lever hinged side door for a walk-in bath tub in accordance with a preferred embodiment of the present invention.
Figure 4B:
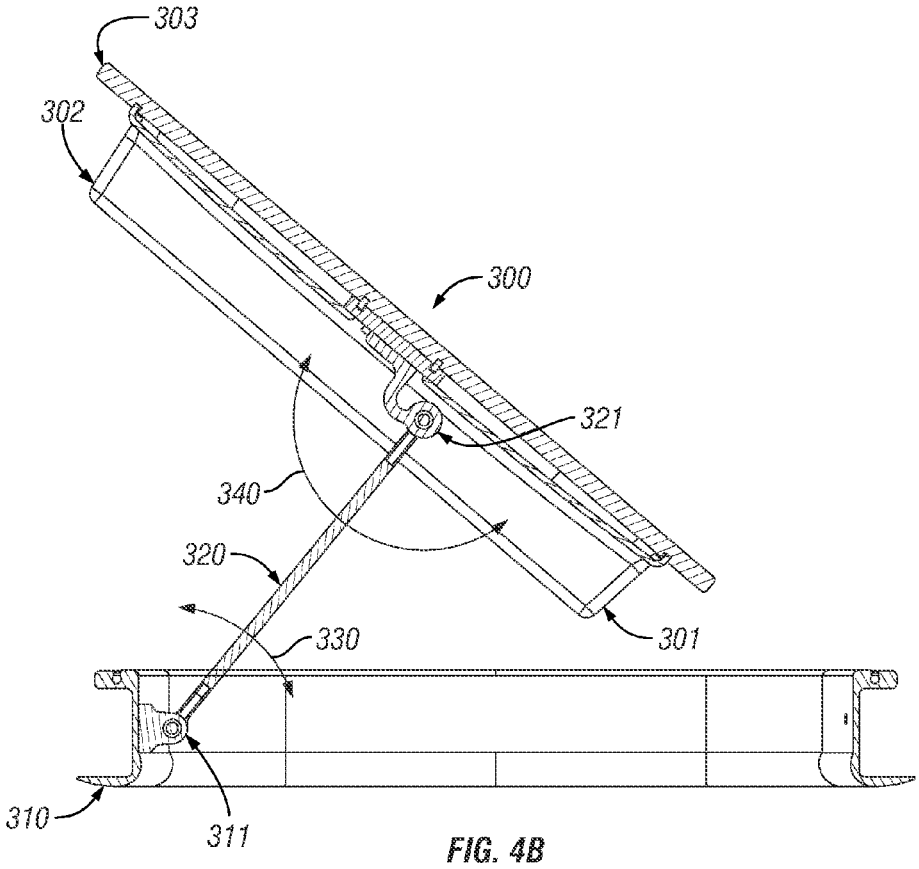
Figure 4C:
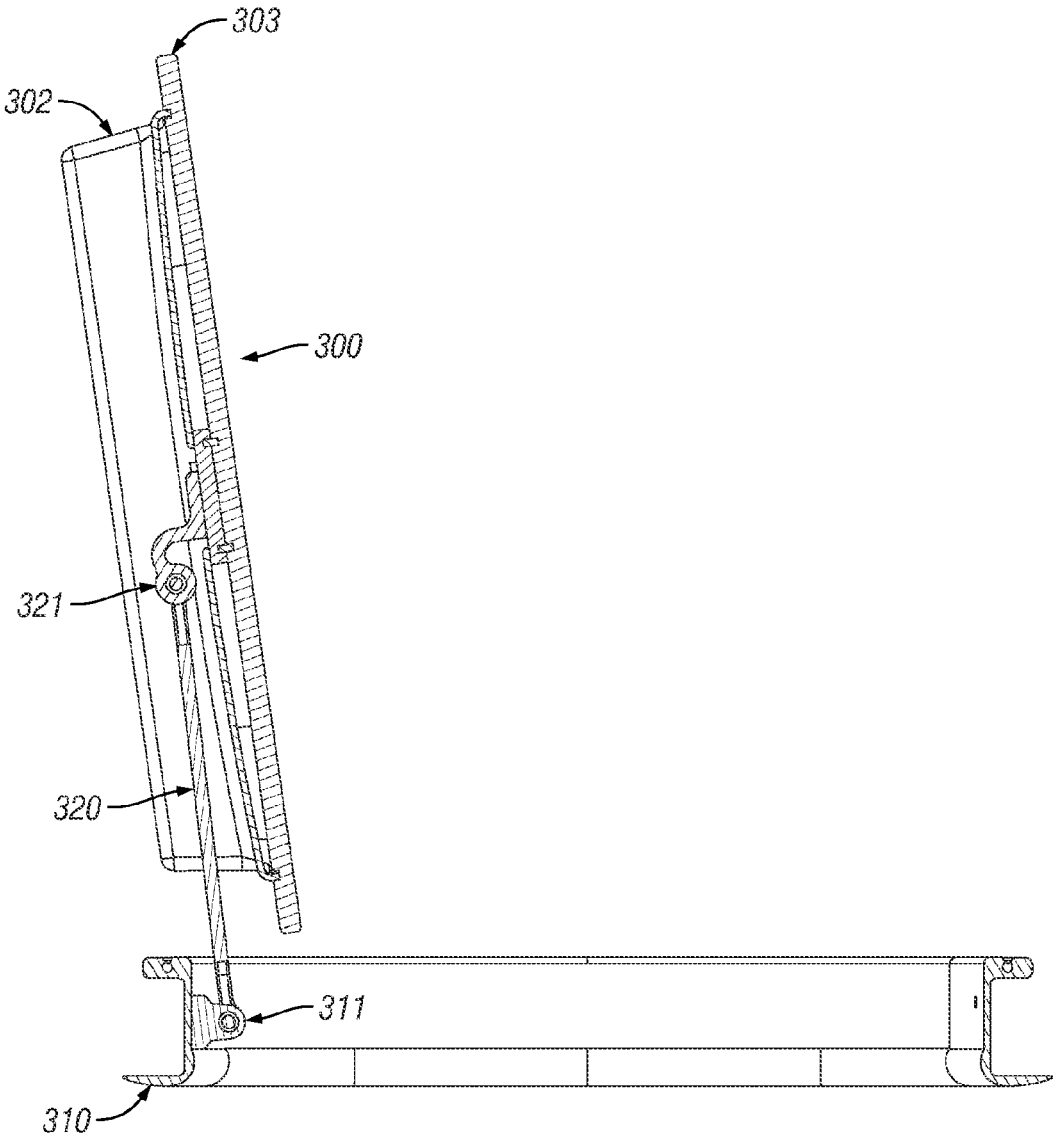

FIGS. 3A-3C show a perspective view of a lever hinged side door for a walk-in bath tub in accordance with a preferred embodiment of the present invention. FIGS. 3A-3C illustrate the manner in which the side door opens. Similarly, FIGS. 4A-4C show a top plan view of the lever hinged side door.

Figure 1:
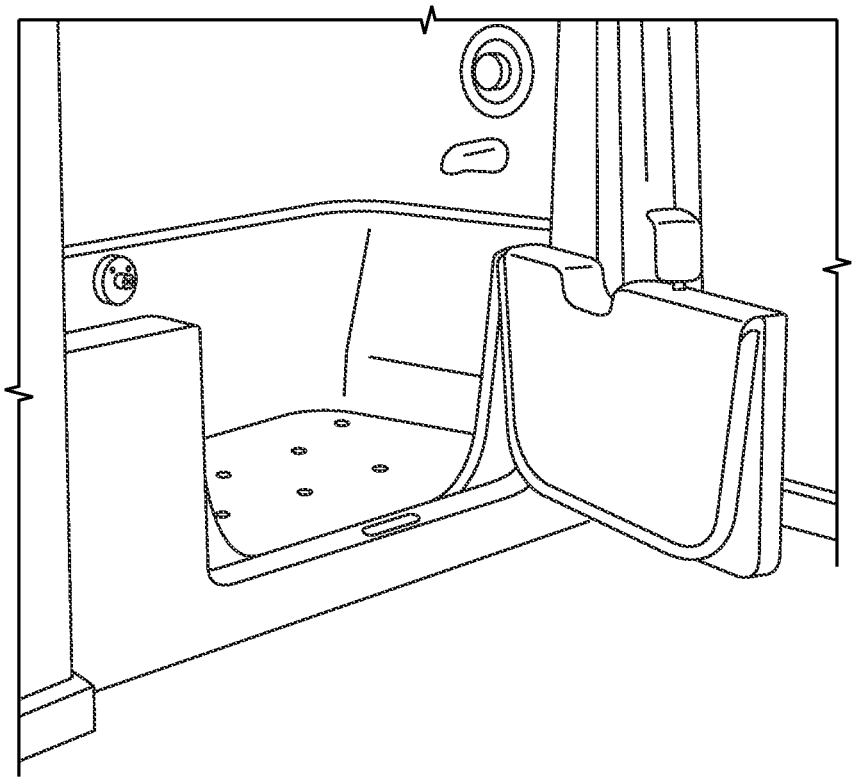
FIG. 1 (Prior Art)
FIG. 1 shows a typical example of a walk-in bathtub with an outward swinging side door in accordance with the prior art.
Figure 2:
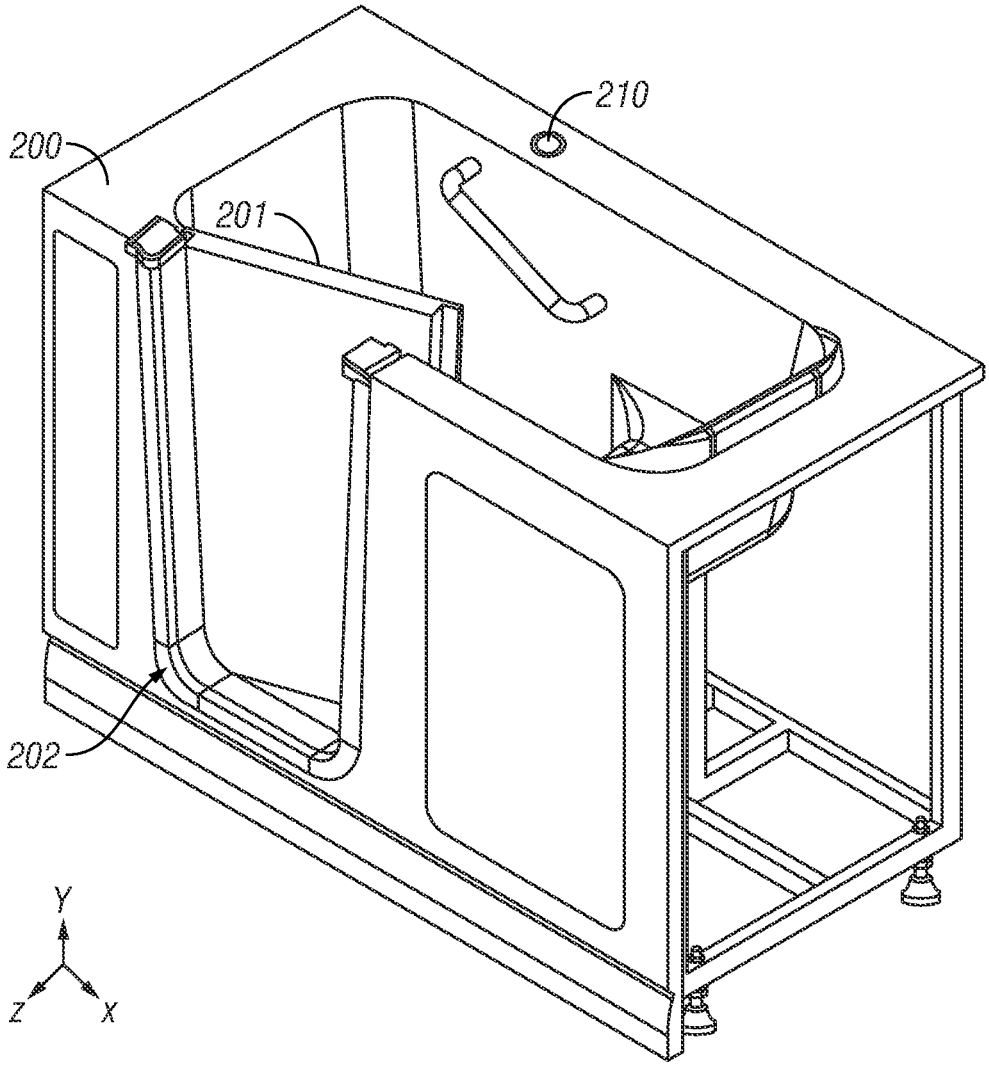
FIG. 2 (Prior Art)
FIG. 2 shows a perspective view of a walk-in bathtub with an inward swinging side door in accordance with the prior art.

In the example shown, the lever hinged door 300 is mounted to a door frame 310 similar to the one shown in FIG. 2. However, it should be mentioned that the present invention can also be used with walk-in tubs that do not utilize a door frame around the threshold.

Unlike prior art designs, the door 300 in the present invention does not hinge directly on the door threshold. Instead, the door 300 is connected to the frame 310 by an intermediate double axis hinge 320. It is this double axis hinge 320 that is connected to the door frame 310 via a first hinge axis mount 311. The other end of the hinge 320 connects to approximately the middle of the door 300 by means of a second hinge axis mount 321.

The double axis hinge 320 and two axis mounts 311, 321 provide the door 300 two degrees of freedom during opening and closing. As shown in FIGS. 3B and 4B, as the door is opened, the hinge 320 rotates on the frame axis mount 311 and follows the inward arc that would be followed by a conventional door, as denoted by arrow 330 in FIG. 4B.

The door itself 300 counter rotates on the second axis mount 321, allowing it to pivot in the opposite direction of the hinge 320, as denoted by arrow 340 in FIG. 4B. As seen in the figures, this counter rotation of the door 300 on the second axis mount 321 causes the distal end 301 of the door to rotate back toward the first axis mount 311 rather than swinging across the foot well. As a result, the swing path of the door 300 is opposite the user and away from the user's legs. The door 300 only crosses part of the foot well, specifically the far outside corner of the foot well (relative to the seat) during opening and closing, leaving the leg space in front of the tub seat largely unobstructed.

By having the door counter rotate on the second axis mount 321 as the hinge 320 rotates about the first axis mount 311, the area of the foot well crossed by the door 300 is determined primarily by the length of the double axis hinge rather than the width of the door and will vary according to the width of the door and door frame as well as the width and length of the foot well. Therefore, with the second axis mount 321 positioned approximately in the center of the door 300, the rotation of the door about the second axis mount reduces the area of the foot well crossed by the door by roughly half compared to the prior art design which hinges at one side of the door, requiring the entire width of the door to swing across the foot well.

FIGS. 3C and 4C show the door in the fully opened position. Like the prior art inward swinging door, the door 300 of the present invention lies along the inner wall of the tub opposite the seat when fully opened, providing easy access into and out of the tub. However, as shown in the figures, because of the pivot around the second hinge axis mount 321, the inner surface of the door 300 faces inward toward the seat instead of facing the inner wall.

As shown in FIGS. 3A-3C, the door 300 comprises a threshold piece 302 and a flat panel 303. As the name implies the threshold piece 302 fills the space of the door threshold and forms the outer surface of the door 300. The flat panel 303 forms the inner surface of the door and is wider than the door threshold, thereby helping to form the water seal by applying pressure to a gasket (not shown) around the perimeter of the door threshold. This gasket may be incorporated into the inner wall of the tub around the perimeter of the threshold or in a preformed frame mounted in the threshold such as frame 310. In an alternate embodiment, the gasket may be incorporated into the perimeter of the flat panel of the door 300.

In the present invention, the threshold piece 302 includes a channel across its width, shown most clearly in FIG. 3B. This channel accommodates the hinge 320 and second axis mount 321 and allows the hinge to recess into the door 300 when the door is in the fully closed and opened positions, as shown in FIGS. 3A and 3C. FIG. 3A shows how the U-shaped geometry of hinge ends allow the second axis mount 321 to fit with the hinge 320 in the closed position. Conversely, FIG. 4C shows how the goose neck geometry of the second axis mount 321 creates a space to allow a hinge cover (shown in FIGS. 5 and 6) mounted on the hinge 320 to nest within the hinge components when the door is fully open.

By allowing the double axis hinge 320 to recess into the threshold piece 302, the channel enables the door 300 of the present invention to occupy the same space as prior art doors, thereby allowing the present invention to be implemented with current tub and door frame designs and be retrofitted to current tubs.

The point of attachment of the second axis mount 321 on the door may vary according to the design of the tub. In the example shown in FIGS. 3A-3C and 4A-4C the hinge 320 and corresponding second axis mount 321 are coupled at approximately the middle of the door 300. However, the location of the hinge axis on the door can vary depending on the dimensions of the door and tub and the desired swing path of the door.

Figure 5A:
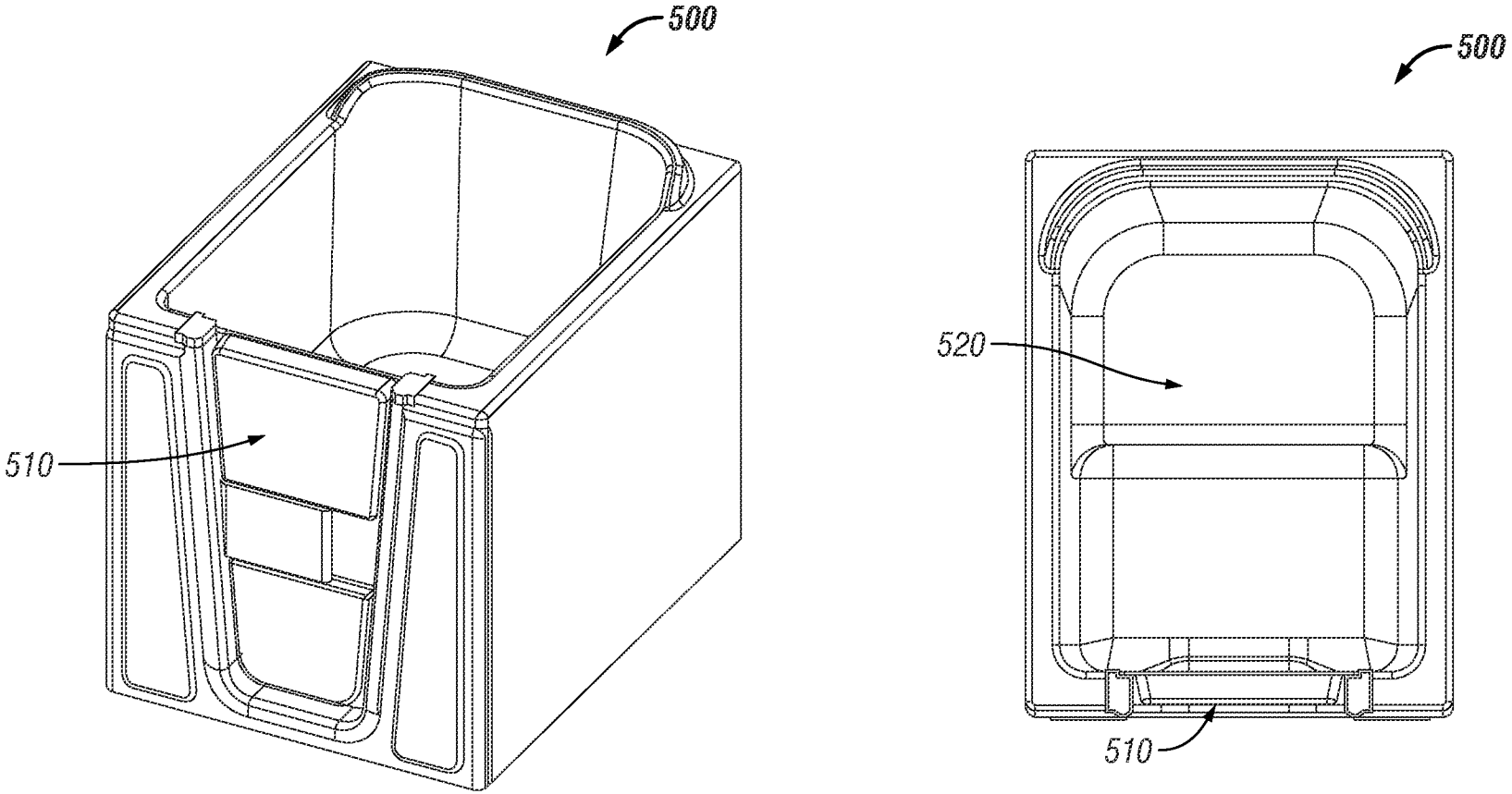
FIGS. 5A-5C shows a top plan view of an alternate embodiment of the present invention with the door located at the end of the tub.
Figure 5B:
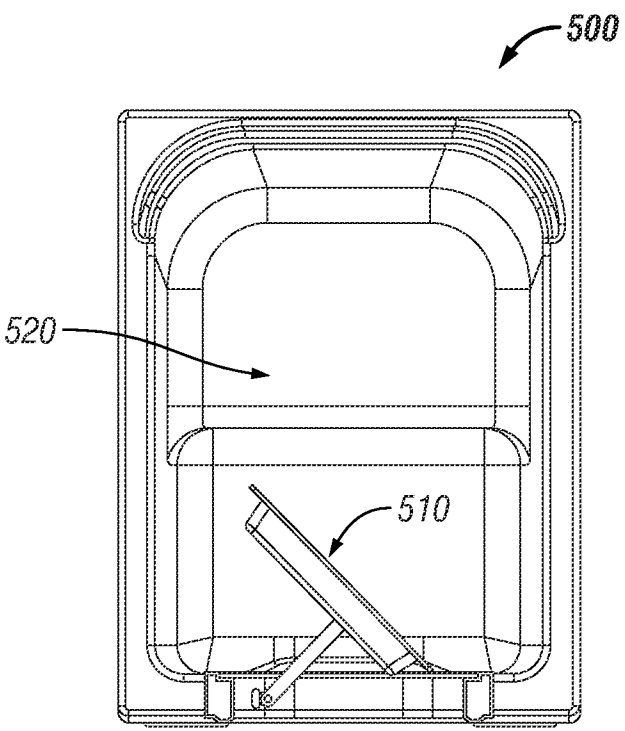
Figure 5B:
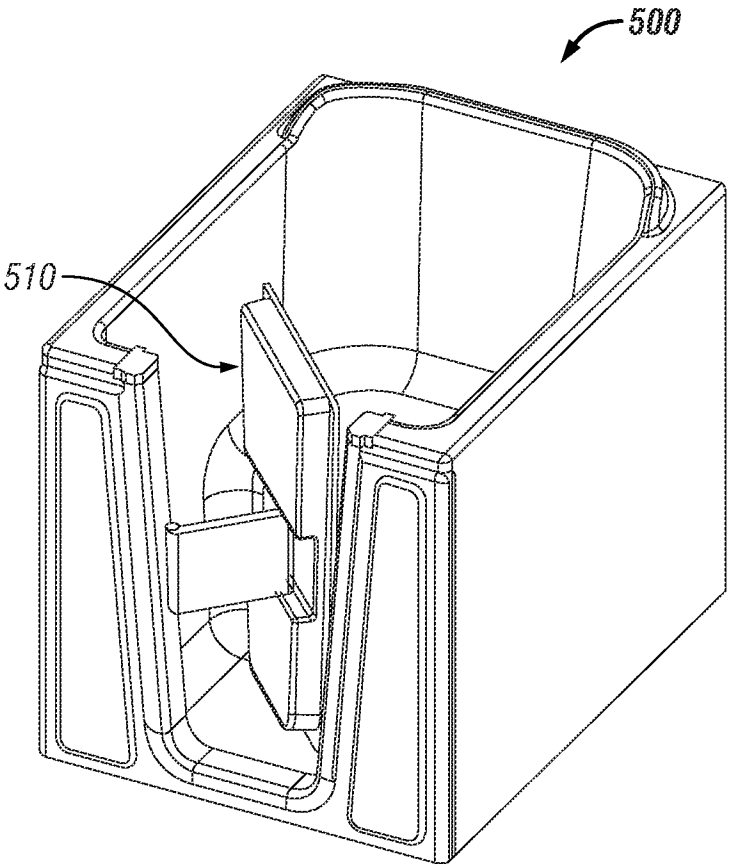
Figure 5C:
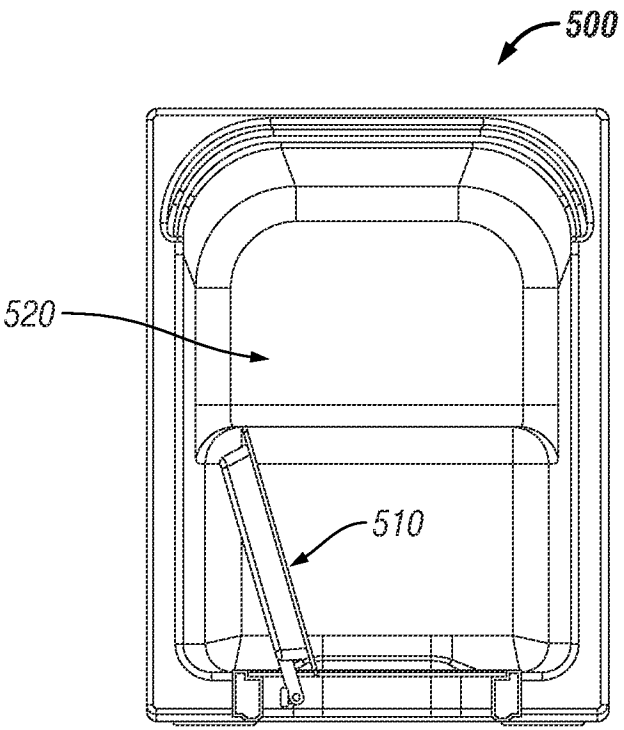
Figure 5C:
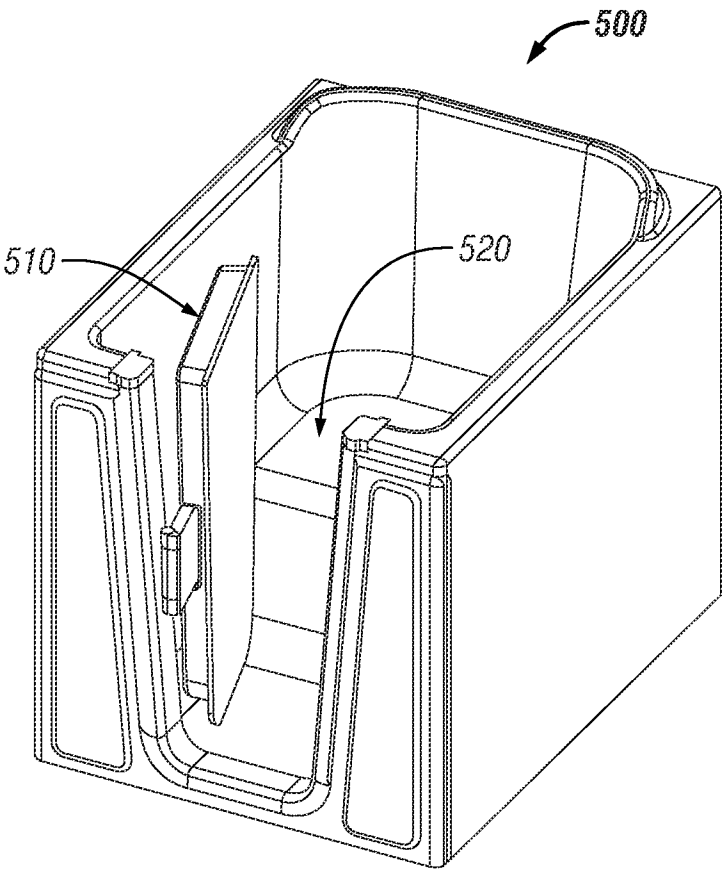

FIGS. 5A-5C show an alternate embodiment of the present invention. FIGS. 5A-5C show both perspective and top plan views of the tub 500 as the door moves between the closed and open positions. In this embodiment, the door 510 is located at the far end of the tub 500, opposite the seat 520. As shown in the figures, the door 510 opens along the side of the tub 500. The opening and closing motion of the door 510 is the same as that of door 300 described above. Like the previous embodiment, this one allows the door 510 to swing away from the user's legs without having to cross over the foot well.

The location of the door on the end as shown in FIG. 5 is not practical for conventional door designs. A conventional door placed at the end of the tub would hit the knees of the user as it swings inward toward the user and across the foot well. The only way in which a conventional door could avoid this problem is if the length of the tub (especially the foot well) is increased, which would increase the distance the user would have to move to get into and out of the seat, as well as the amount of reach necessary to open and close the door from the seated position. Again, one must always remember that the primary user population will have some degree of movement impairment. Therefore, these seemingly trivial inconveniences due to increased tub length can pose significant problems for many users. By allowing the door 510 to swing to the side and away from the user's knees, the door system of the present invention permits an inward opening door to be placed at the end of tubs that are not very long (e.g., 36×36 in.) without interfering with the user's legs.

Figure 6A:
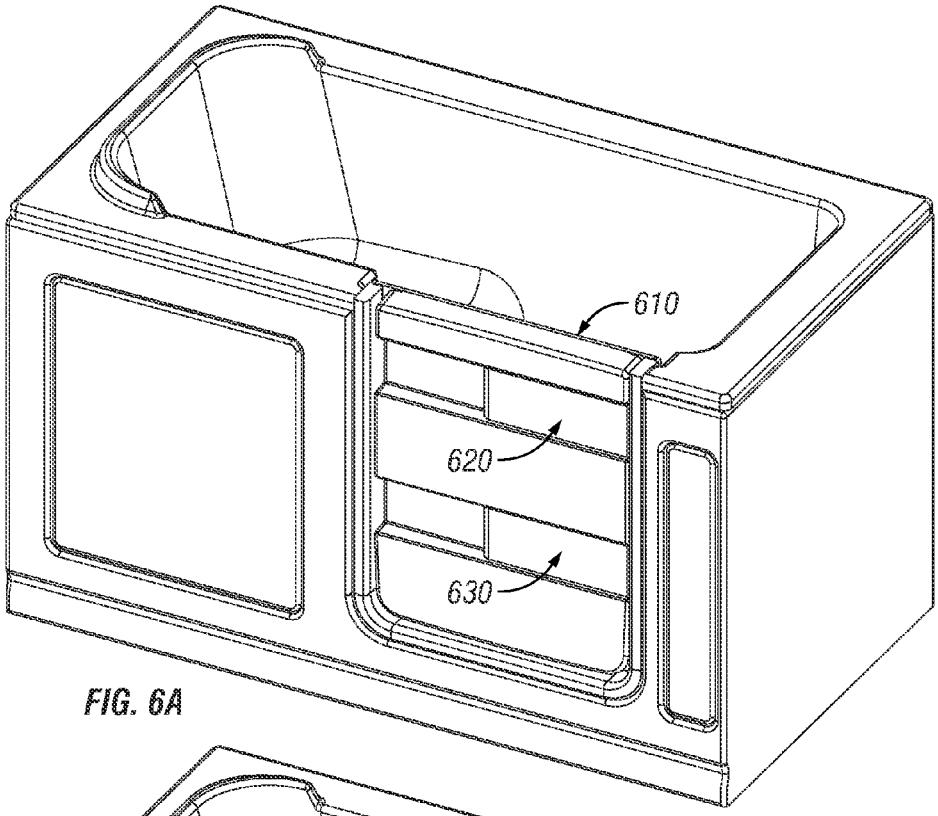
FIGS. 6A-6C show another embodiment of the present invention employing multiple double axis hinges.
Figure 6B:
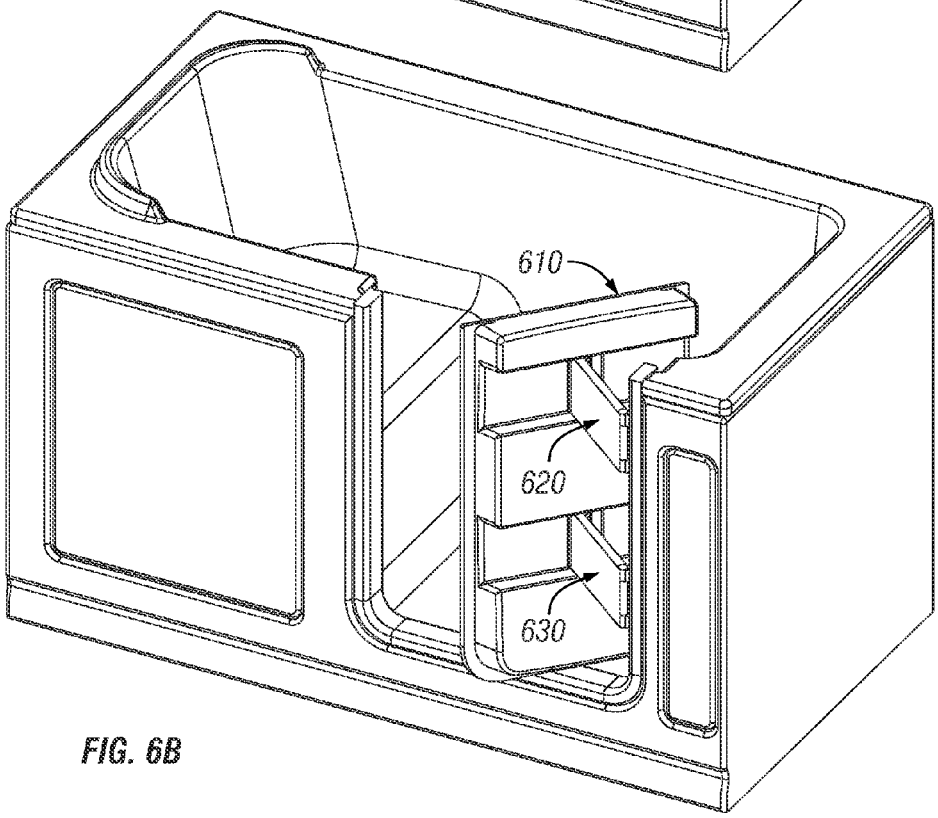
Figure 6C:
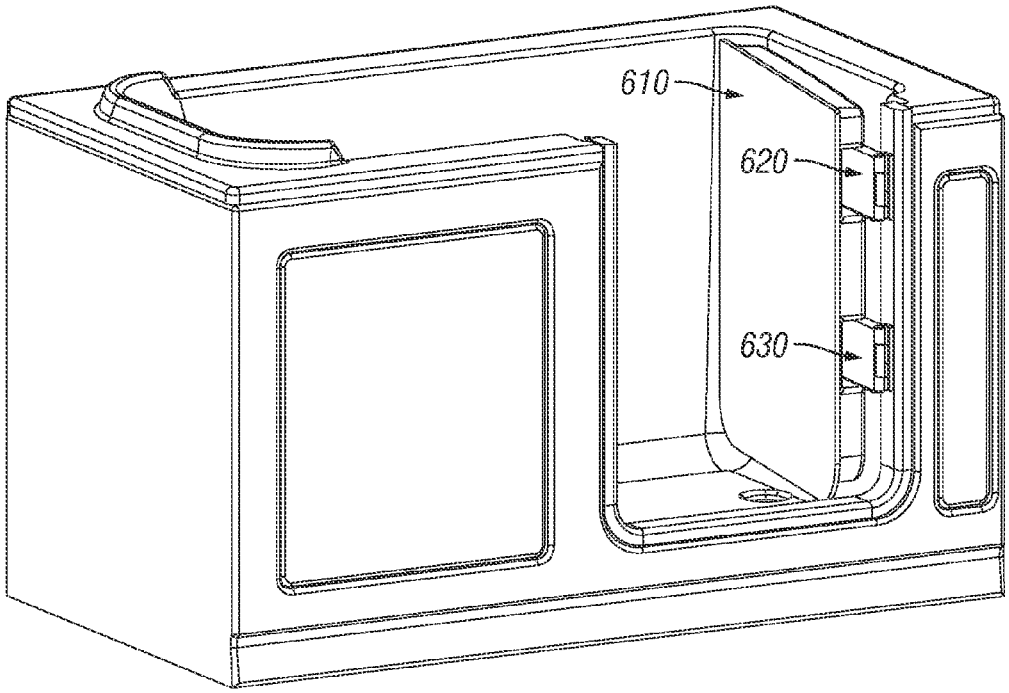

FIGS. 6A-6C show another embodiment of the present invention employing multiple double axis hinges. Multiple hinges provide additional structural stability to the door during opening and closing depending on the size and weight of the door. In the example shown in FIGS. 6A-6C, two double axis-hinges 620, 630 are connected to the door 610. However, more than two hinges may be used. The structure and operation of the hinges 620, 630 is the same as hinge 320.

It should be understood that the multiple double-axis hinge door shown in FIGS. 6A-6C can also be applied to the tub configuration shown in FIGS. 5A-5C with the door on the end opposite the seat rather than in the side wall.

Figure 7A:
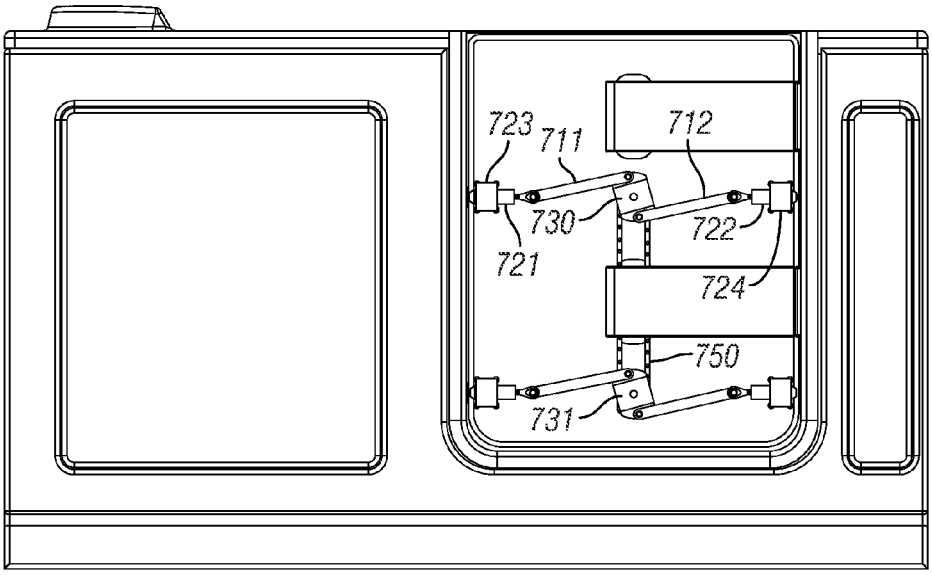
FIGS. 7A-7C illustrate a locking mechanism used to secure the tub door when the door is in the closed position.
Figure 7A:
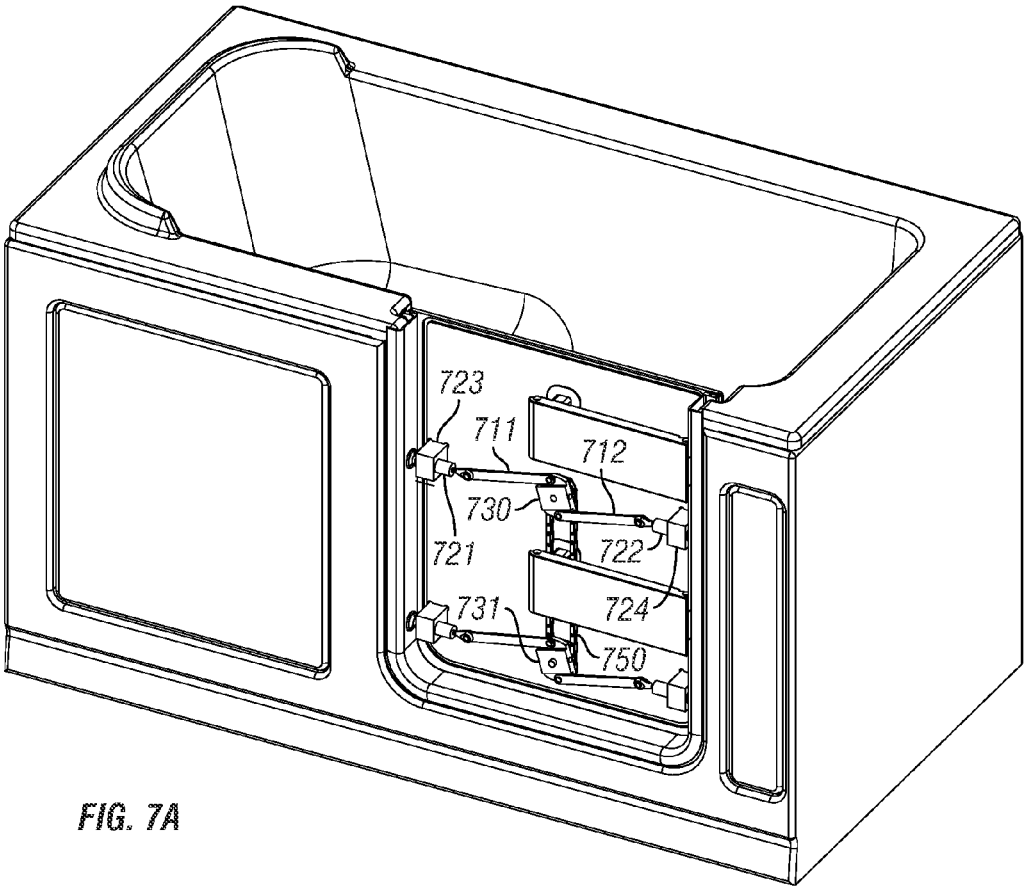
Figure 7B:
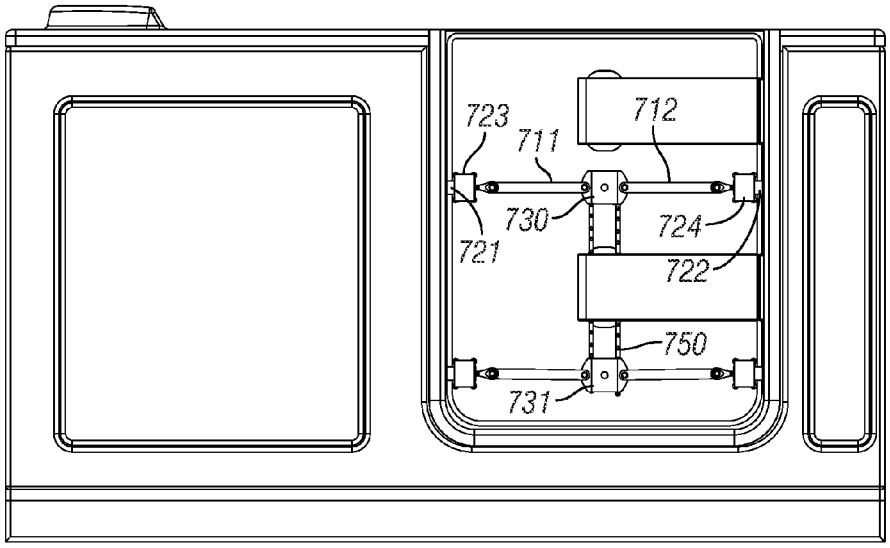
Figure 7B:
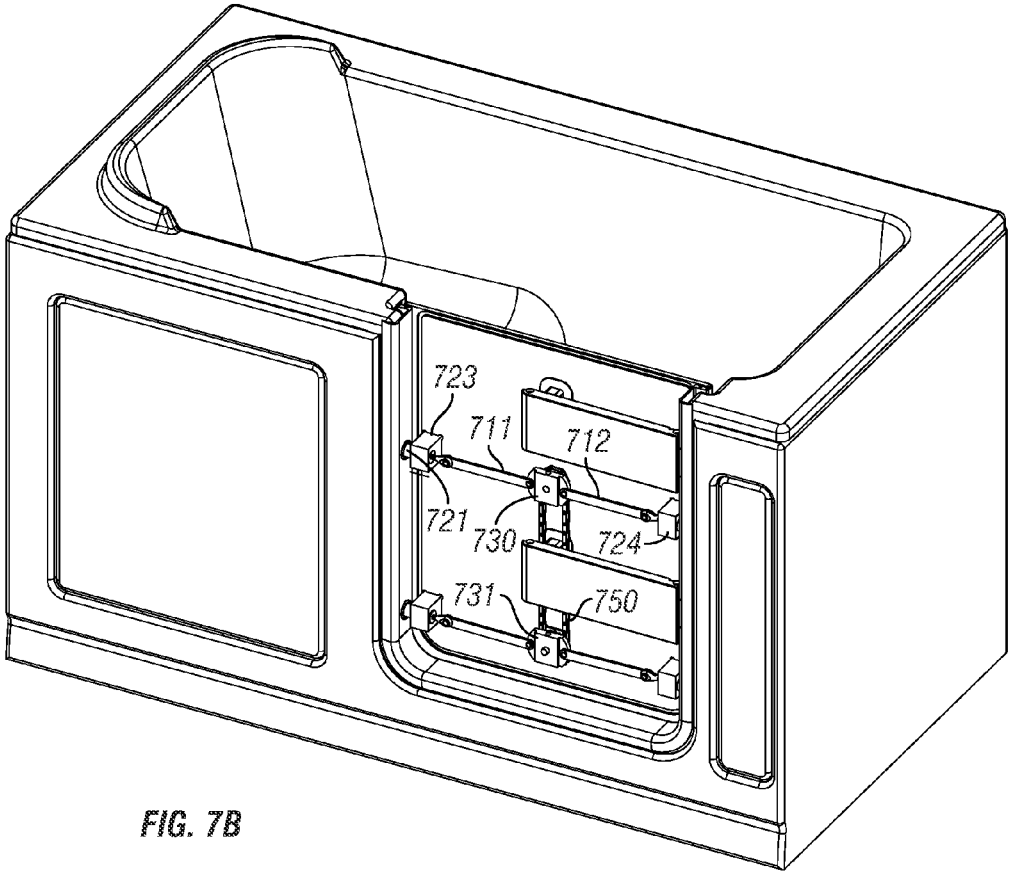
Figure 7C:
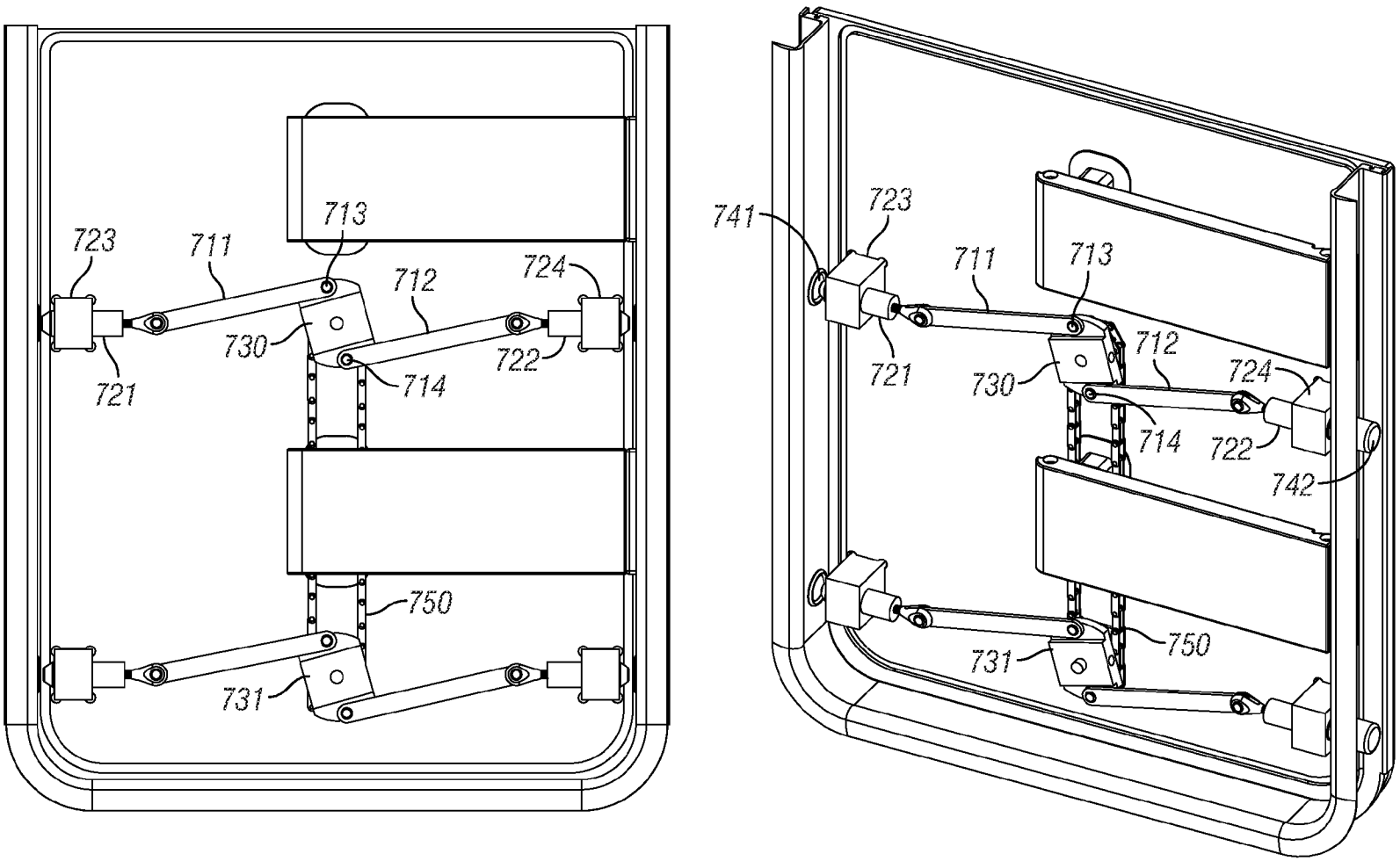

FIGS. 7A-7C illustrate a locking mechanism used to secure the tub door when the door is in the closed position. FIG. 7A shows the locking mechanism in the open position, and FIG. 7B shows the locking mechanism in the closed position. FIG. 7C shows a closer view of the locking mechanism, door and door frame in isolation from the tub.

The locking mechanism is internal to the door and is illustrated here with the outer door panel removed. The mechanism comprises two locking levers 711, 712 that are pivotally coupled to locking pins 721, 722 at one end and a central rotating mount 731 at the other. The locking pins are held within respective pins guides 723, 724 that keep the pins moving in a straight line as they are pushed and pulled by the pivotally coupled locking levers 711, 712, similar to cylinders for pistons driven by a crank shaft. The rotating mount 730 is operated by a handle 800 (shown in FIG. 8A) on the inside of the door.

As shown in the figures, the locking levers 711, 712 are pivotally coupled to opposite ends of the rotating mount 730 across from each other. Each lever pivots on a respective axis 713, 714 (shown more clearly in FIG. 7C). In the present example, both levers 711, 712 are coupled to the outer face of the rotating member 730, but they can be coupled to the inner face or on opposite faces of the mount as well.

Because they point in opposite directions, the levers 711, 712 move in opposite directions as the central rotating mount 730 turns. In the example shown, when the rotating mount 730 move counterclockwise, the locking levers 711, 712 are pushed outward, causing the pivotally coupled locking pins 721, 722 to slide into respective locking recesses 741, 742 in the door frame, thereby locking the door in the closed position (pictured in FIG. 7B). Turning the rotating mount 730 in the clockwise direction pulls the locking pins 721, 722 out of the locking recesses 741, 742, thereby unlocking the door (pictured in FIG. 7A).

It should be noted that if the rotating mount 730 were to continue rotating counterclockwise past the locked position shown in FIG. 7B it would pull the locking pins 721, 722 back out. However, as explained in more detail below, the handle that operates the rotating mount 730 prevents it from rotating past the locked position.

In the example shown in FIGS. 7A-7C the door includes two locking mechanisms. To enable them to operating in unison, a drive chain 750 links the two rotating members 730, 731 so that both can be operated by the door handle, similar to a bicycle chain.

The number of locking mechanisms incorporated into the door will depend on the size of the door and depth of the tub. One locking mechanism might be sufficient for smaller doors, whereas three or more might be needed for larger ones. In addition, depending on the size and width of the door, the locking mechanism might only include one locking lever and locking pin on one side of the door, rather than two levers moving in opposite directions to secure both sides of the door.

Figure 8A:
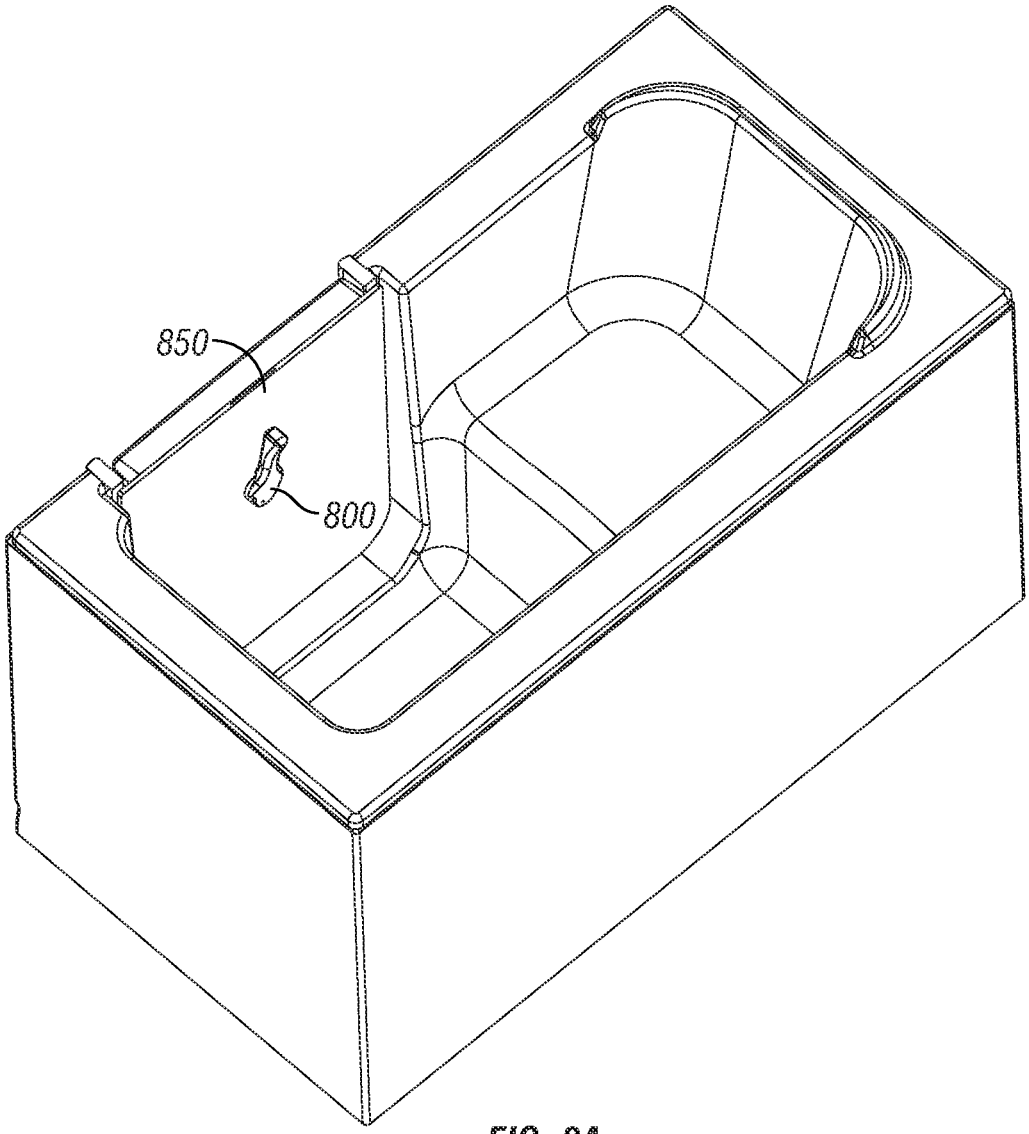
FIGS. 8A-8C show the door handle of the present invention.
Figure 8B:
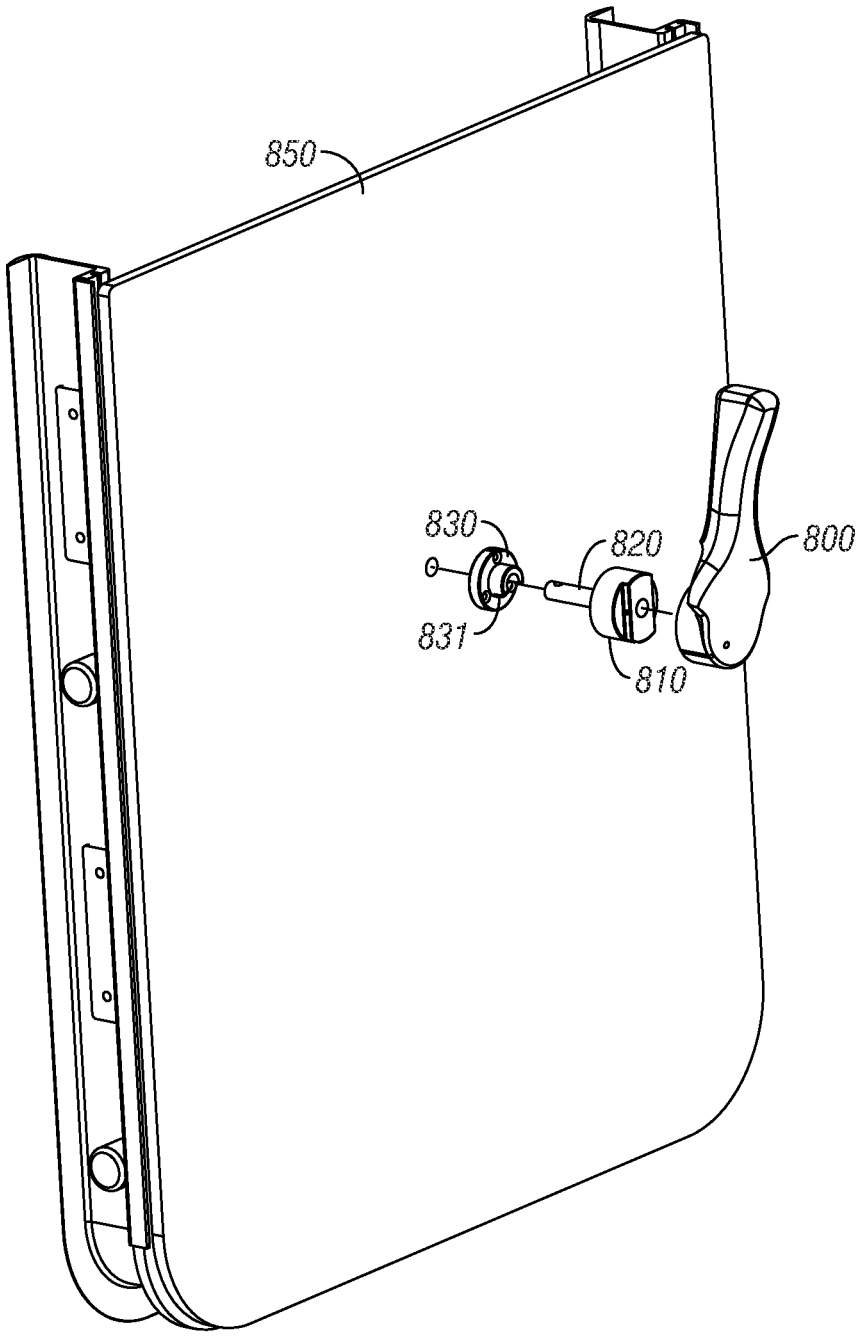
Figure 8C:
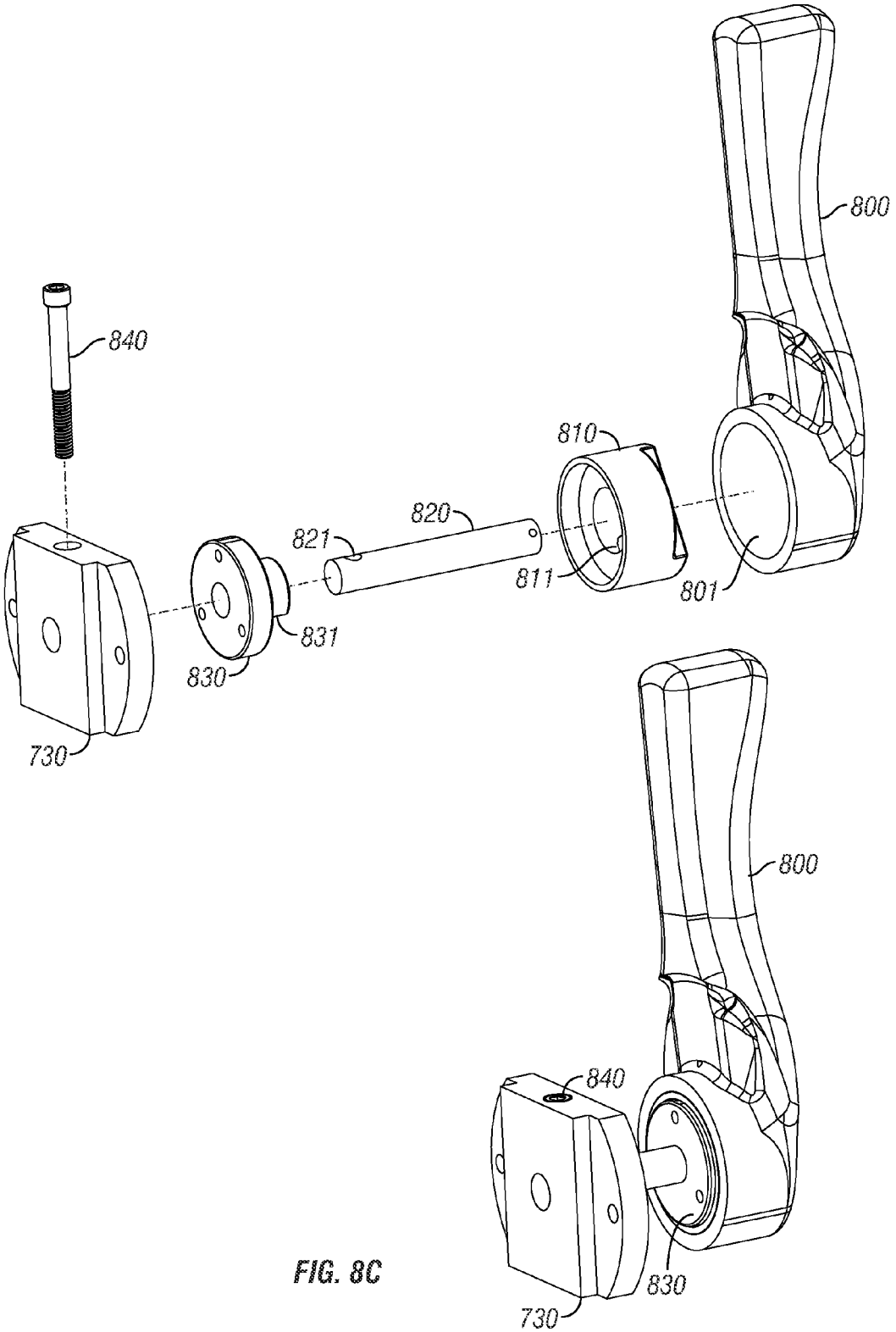

FIGS. 8A-8C show the door handle of the present invention. FIG. 8A shows the handle 800 mounted on the internal panel of the tub door 850. FIG. 8B is an exploded view showing how the handle assembly is coupled to the door panel 850. FIG. 8C shows exploded and assembled views of how the handle assembly is coupled to the rotating mount 730 of the locking mechanism shown in FIGS. 7A-7C.

The handle 800 turns the rotating mount 730 by means of a shaft 820 that passes through the inner door panel 850. The shaft 820 is secured to the rotating mount 730 by means of a screw 840 that passes through a hole 821 in the shaft 820 when the shaft is inserted into the rotating mount, as shown in FIG. 8C. The other end of the shaft 820 is coupled to a fitted insert 820 that engages a recess 801 in the base of the handle 800.

The rotation of the handle 800 and rotating mount 730 is controlled by a flanged handle mount 830 secured to the inner door panel 850. The flange 831 on the door mount 830 is semicircular, which can be seen most clearly in FIG. 8B. The fitted insert 820 in the base of the handle 800 accommodates the flange 810 of the door mount 830, and has a turn stop protrusion 811 (shown in FIG. 8C) that buts into the flange 831, thereby restricting the rotation of the handle 800 to approximately 180°.

The description of the present invention has been presented for purposes of illustration and description, and is not intended to be exhaustive or limited to the invention in the form disclosed. Many modifications and variations will be apparent to those of ordinary skill in the art. The embodiment was chosen and described in order to best explain the principles of the invention, the practical application, and to enable others of ordinary skill in the art to understand the invention for various embodiments with various modifications as are suited to the particular use contemplated. It will be understood by one of ordinary skill in the art that numerous variations will be possible to the disclosed embodiments without going outside the scope of the invention as disclosed in the claims.

We claim:

1. A door assembly for a walk-in bathtub, the door assembly comprising:

(a) a door shaped to fit a door threshold in a wall of a walk-in bathtub, wherein the door includes an outer side for fitting within a threshold in a wall of a walk-in bathtub and an interior side for facing an inside of a walk-in bathtub; and (b) at least one hinge assembly that includes:

(i) a first axis mount for coupling to a threshold of a walk-in bathtub;

(ii) a second axis mount coupled to the outer side of the door, within a channel in the outer side of the door; and (iii) a double axis hinge coupled to both of said first and second axis mounts, for thereby connecting the door to a threshold of a walk-in bathtub;

(c) wherein the double axis hinge, when the door is in an open position, opens the door toward an inside of a walk-in bathtub by pivoting about the first axis mount toward an inside of a walk-in bathtub as the door itself freely counter rotates about the second axis mount in a direction opposite that of the hinge, wherein the interior side of the door faces an inside of a walk-in bathtub in both closed and opened positions.

2. The door assembly according to claim 1, further comprising a door frame for mounting in a door threshold of a walk-in bathtub, wherein the first axis mount is coupled to the frame.

3. The door assembly according to claim 1, wherein the channel in the outer side of the door extends across a width of the door, and wherein the double axis hinge recesses into said channel in the outer side of the door in both the closed and opened positions.

4. A door assembly for a walk-in bathtub, comprising:

(a) a door shaped to fit a door threshold in a wall of a walk-in bathtub, wherein the door includes an outer side for fitting within a threshold in a wall of a walk-in bathtub and an interior side for facing an inside of a walk-in bathtub;

(b) at least one hinge assembly that includes:

(i) a first axis mount for coupling to a threshold of a walk-in bathtub;

(ii) a second axis mount coupled to the outer side of the door, within a channel in the outer side of the door; and (iii) a double axis hinge coupled to both of said first and second axis mounts, for thereby connecting the door to a threshold of a walk-in bathtub;

(c) wherein the double axis hinge, when the door is in an open position, opens the door toward an inside of a walk-in bathtub by pivoting about the first axis mount toward an inside of a walk-in bathtub as the door itself freely counter rotates about the second axis mount in a direction opposite that of the hinge, wherein the interior side of the door faces an inside of a walk-in bathtub in both closed and opened positions; and a panel covering the double axis hinge, wherein the second axis mount has a goose neck shape that creates a space between the second axis mount and the outer side of the door, wherein the end of said panel fits within said space when the door is in the opened position.

5. The door assembly according to claim 1, wherein said second axis mount is positioned approximately in the middle of a width of the outer side of the door.

6. The door assembly according to claim 1, wherein the door comprises two parts: an outer cap shaped to fit within a door threshold in a side of a walk-in bathtub; and an interior panel with a perimeter larger than a perimeter of a door threshold of a walk-in bathtub, wherein the interior panel assists in forming a water seal on an inside of a walk-in bathtub.

7. The door assembly according to claim 1, further comprising at least one locking mechanism inside the door, wherein the locking mechanism comprises: a rotating mount; at least one locking lever; at least one locking pin for fitting within a recess in a door threshold in a walk-in bathtub; and at least one pin guide that holds the locking pin and maintains back and forth movement of the locking pin in a straight line; wherein a first end of the locking lever is pivotally coupled to the rotating mount and a second end of the locking lever is pivotally coupled to the locking pin; and wherein the locking lever pushes the locking pin into a recess in a door threshold of a walk-in bathtub when the rotating mount turns in a first direction, and wherein the locking lever pulls the locking pin out of a recess in a door threshold of a walk-in bathtub when the rotating mount turns in a second direction.

8. The door assembly according to claim 7, wherein the locking mechanism is controlled by a handle coupled to the door.

9. The door assembly according to claim 1, further comprising multiple hinge assemblies connecting the door to the bathtub and multiple channels within the door for such assemblies.

10. A walk-in bathtub, comprising:

(a) a bathtub having a wall with a door threshold therein;

(b) a door shaped to fit said threshold, wherein the door includes a outer side that fits within said threshold and an interior side that faces an inside of the bathtub; and (c) at least one hinge assembly that includes:

(i) a first axis mount coupled to said threshold;

(ii) a second axis mount coupled to the outer side of the door, within a channel in the door; and (iii) a double axis hinge coupled to both of said axis mounts, thereby connecting the door to the threshold;

(d) wherein the double axis hinge opens the door to the inside of the bathtub by pivoting about the first axis mount toward the inside of the bathtub as the door itself freely counter rotates about the second axis mount in a direction opposite that of the hinge, wherein the interior side of the door faces the inside of the bathtub in both the closed and opened positions.

11. The walk-in bathtub according to claim 10, further comprising a door frame mounted in the door threshold, wherein the first axis mount is coupled to the frame.

12. The walk-in bathtub according to claim 10, wherein the channel in the outer side of the door extends across the width of the door, and wherein the double axis hinge recesses into said channel in the outer side of the door in both the closed and opened positions.

13. A walk-in bathtub, comprising (a) a bathtub having a wall with a door threshold therein;

(b) a door shaped to fit said threshold, wherein the door includes a outer side that fits within said threshold and an interior side that faces an inside of the bathtub;

(c) at least one hinge assembly that includes:

(i) a first axis mount coupled to said threshold;

(ii) a second axis mount coupled to the outer side of the door, within a channel in the door; and (iii) a double axis hinge coupled to both of said axis mounts, thereby connecting the door to the threshold;

(d) wherein the double axis hinge opens the door to the inside of the bathtub by pivoting about the first axis mount toward the inside of the bathtub as the door itself freely counter rotates about the second axis mount in a direction opposite that of the hinge, wherein the interior side of the door faces the inside of the bathtub in both the closed and opened positions; and a panel covering the double axis hinge, wherein the second axis mount has a goose neck shape that creates a space between the second axis mount and the outer side of the door, wherein the end of said panel fits within said space when the door is in the opened position.

14. The walk-in bathtub according to claim 10, wherein the door comprises two parts: an outer cap shaped to fit within the door threshold in the side of the walk-in bathtub; and an interior panel with a perimeter larger than a perimeter of the door threshold, wherein the interior panel assists in forming a water seal on the inside of the bathtub.

15. The walk-in bathtub according to claim 10, further comprising at least one locking mechanism inside the door, wherein the locking mechanism comprises: a rotating mount; at least one locking lever coupled; and at least one locking pin that fits within a recess in the door threshold; wherein a first end of the locking lever is coupled to the rotating mount and a second end of the locking lever is coupled to the locking pin; and wherein the locking lever pushes the locking pin into the recess in the door threshold when the rotating mount turns in a first direction, and wherein the locking lever pulls the locking pin out of the recess in the door threshold when the rotating mount turns in a second direction.

16. The walk-in bathtub according to claim 15, wherein the locking mechanism is controlled by a handle coupled to the door.

17. The walk-in bathtub according to claim 10, further comprising multiple hinge assemblies connecting the door to the bathtub and multiple channels within the outer side of the door for such assemblies.

18. The walk-in bathtub according to claim 10, wherein the door threshold is located in a side wall of the bathtub.

19. The walk-in bathtub according to claim 10, wherein the door threshold is located in an end of the bathtub opposite a built-in seat.

20. A door assembly for a walk-in bathtub, the door assembly comprising:

(a) a door shaped to fit a door threshold in a wall of a walk-in bathtub, wherein the door includes an outer side for fitting within a threshold of a walk-in bathtub and an interior side for facing an inside of a walk-in bathtub;

(b) at least one hinge assembly for connecting the door to a threshold of a walk-in bathtub; and (c) at least one locking mechanism inside the door, wherein the locking mechanism includes:

(i) a rotating mount;

(ii) at least one locking lever;

(iii) at least one locking pin that fits within a recess in a door threshold of a walk-in bathtub; and (iv) at least one pin guide that holds the locking pin and maintains back and forth movement of the locking pin in a straight line; wherein a first end of the locking lever is pivotally coupled to the rotating mount and a second end of the locking lever is pivotally coupled to the locking pin; and wherein the locking lever pushes the locking pin into a recess in a door threshold of a walk-in bathtub when the rotating mount turns in a first direction, and wherein the locking lever pulls the locking pin out of a recess in a door threshold of a walk-in bathtub when the rotating mount turns in a second direction.

* * * * *